US012607142B2

(12) United States Patent
Husberg et al.

(10) Patent No.: US 12,607,142 B2
(45) Date of Patent: Apr. 21, 2026

(54) TRANSMISSION DEVICE FOR DRIVING A FAN OF A COOLING CIRCUIT OF AN INTERNAL COMBUSTION ENGINE, ASSOCIATED COOLING CIRCUIT, AND VEHICLE

(71) Applicant: Volvo Truck Corporation, Gothenburg (SE)

(72) Inventors: Tobias Husberg, Kareby (SE); Marcos Lima, Gothenburg (SE)

(73) Assignee: Volvo Truck Corporation, Gothenburg (SE)

( * ) Notice: Subject to any disclaimer, the term of this patent is extended or adjusted under 35 U.S.C. 154(b) by 0 days.

(21) Appl. No.: 18/982,412

(22) Filed: Dec. 16, 2024

(65) Prior Publication Data

US 2025/0207526 A1 Jun. 26, 2025

(30) Foreign Application Priority Data

Dec. 20, 2023 (EP) ..... 23218824

(51) Int. Cl.
*F01P 5/04* (2006.01)
*F01P 7/00* (2006.01)

(52) U.S. Cl.
CPC ..... *F01P 5/04* (2013.01); *F01P 2005/046* (2013.01)

(58) Field of Classification Search
CPC .... F01P 5/04; F01P 7/046; F01P 7/048; F01P 7/08; F01P 7/082; F01P 7/081; F01P 2005/046; F01P 2050/22
See application file for complete search history.

(56) References Cited

U.S. PATENT DOCUMENTS

| | | | | |
|---|---|---|---|---|
| 1,900,586 | A | 3/1933 | Rippe | |
| 3,283,527 | A | 11/1966 | Cauvin | |
| 3,522,795 | A * | 8/1970 | Seifert | F01P 7/08 192/82 T |
| 3,894,521 | A | 7/1975 | Sakasegawa et al. | |
| 5,415,134 | A | 5/1995 | Stewart, Jr. | |
| 8,544,575 | B1 | 10/2013 | Scaringe et al. | |

(Continued)

FOREIGN PATENT DOCUMENTS

| | | | |
|---|---|---|---|
| CN | 114856793 | A | 8/2022 |
| DE | 2349945 | A1 | 4/1974 |

(Continued)

OTHER PUBLICATIONS

European Search Report for European Patent Application No. 23218824, completed Jun. 3, 2024, 2 pages.

*Primary Examiner* — Grant Moubry
(74) *Attorney, Agent, or Firm* — Withrow & Terranova, PLLC

(57) ABSTRACT

Transmission device between an engine and a fan comprises an input device, configured to be driven in rotation by the engine, and an output device, configured to be linked to the fan so as to drive the fan in rotation. Advantageously, the transmission device also comprises a first clutch, which is linked to the output device, a second clutch, which is linked to the input device, a shaft, which connects mechanically the first clutch to the second clutch, and an electric motor, which is arranged on the shaft between the first clutch and the second clutch. The first clutch and the second clutch are switchable, between their respective open and closed states, independently from each other.

6 Claims, 2 Drawing Sheets

(56) References Cited

U.S. PATENT DOCUMENTS

| | | | | |
|---|---|---|---|---|
| 2012/0107145 | A1* | 5/2012 | Roby | G01P 3/487<br>417/223 |
| 2018/0162217 | A1* | 6/2018 | Stahl | F01P 7/042 |
| 2022/0268198 | A1* | 8/2022 | Hennessy | F04D 25/02 |

FOREIGN PATENT DOCUMENTS

| | | | |
|---|---|---|---|
| DE | 10035765 | A1 | 2/2002 |
| DE | 102010005407 | A1 | 7/2011 |
| KR | 20090042386 | A | 4/2009 |

* cited by examiner

TRANSMISSION DEVICE FOR DRIVING A FAN OF A COOLING CIRCUIT OF AN INTERNAL COMBUSTION ENGINE, ASSOCIATED COOLING CIRCUIT, AND VEHICLE

PRIORITY APPLICATIONS

The present application claims priority to European Patent Application No. 23218824.3, filed on Dec. 20, 2023, and entitled "TRANSMISSION DEVICE FOR DRIVING A FAN OF A COOLING CIRCUIT OF AN INTERNAL COMBUSTION ENGINE, ASSOCIATED COOLING CIRCUIT, AND VEHICLE," which is incorporated herein by reference in its entirety.

TECHNICAL FIELD

The disclosure relates generally to the field of internal combustion engines. In particular aspects, the disclosure relates to a transmission device for driving a fan of a cooling circuit of an internal combustion engine, to a cooling circuit comprising such a transmission device, and to a vehicle comprising such a cooling circuit.

The disclosure can be applied in heavy-duty vehicles, such as trucks, buses, and construction equipment or, alternatively, in stationary applications such as generator sets. Although the disclosure will be described with respect to a particular vehicle, the disclosure is not restricted to any particular vehicle.

BACKGROUND

Internal combustion engine are usually equipped with a cooling circuit, in which a coolant circulates. The engine may be part of a vehicle, especially a heavy-duty vehicle. The cooling circuit comprises an air/liquid heat exchanger, to exchange thermal energy—i.e. heat-between surrounding air and the coolant, and a fan to force air circulation through the heat exchanger.

The fan operated at different regimes, depending on the operating conditions of the engine, for example depending on driving conditions of the vehicle. Most of the time, the fan operates at low speed, in other words at low load, and requires little energy. In specific conditions, the fan operates at high load, where the fan consumes a high level of energy.

Moreover, today's vehicles tend to have higher and higher need for electrical energy for other auxiliary use, and fuel efficiency is more and more important.

SUMMARY

There is therefore a need for a transmission device with improved flexibility and overall improved energy consumption in various operating conditions.

An aspect of the disclosure concerns a transmission device for a fan of a cooling circuit of an internal combustion engine, the transmission device being configured to drive the fan in rotation and comprising:

- an input device, configured to be driven in rotation by the engine, and
- an output device, configured to be linked to the fan so as to drive the fan in rotation, wherein the transmission device comprises:

- a first clutch, which is linked to the output device,
- a second clutch, which is linked to the input device,

- a shaft, which connects mechanically the first clutch to the second clutch, and
- an electric motor, which is arranged on the shaft between the first clutch and the second clutch, and wherein:

- the first clutch is switchable between a closed state, where the first clutch mechanically connects the shaft to the output device, so as to couple in rotation the output device with the shaft, and an open state, where the output device is not driven in rotation by the shaft,
- the second clutch is switchable between a closed state, where the second clutch mechanically connects the shaft to the input device so as to couple the shaft in rotation with the input device, and an open state, where the shaft is not driven in rotation by the input device;
- the first clutch and the second clutch are switchable, between their respective open and closed states, independently from each other.

According to an aspect of the disclosure, an object is achieved by an inventive concept disclosed herein. Hereby, a technical effect includes operating the transmission device so as to minimize energy losses and wear of the vehicle under various operating conditions of the vehicle.

In certain examples, the transmission device is switchable between several functioning modes, including:

- a first functioning mode, where the first clutch and the second clutch are both in a closed state, so that the input device is coupled in rotation with the output device;
- a second functioning mode, where the second clutch is in the open state, the first clutch is in the closed state, and the output device is configured to be driven in rotation by the electrical motor; and
- a third functioning mode, where the first clutch is in the open state, the second clutch is in the closed state, and the electric motor is configured to be driven in rotation by the input device, the electric motor acting as an alternator.

Hereby, a technical effect includes proposing simple and efficient functioning modes, so that when the transmission device is part of a vehicle, efficiency is maximized depending on operating conditions of the vehicle.

In certain examples, the transmission device is switchable between several functioning modes, including:

- a fourth functioning mode, where the first clutch and the second clutch are both in the closed state, and the electric motor is used as an alternator.

In certain examples, transmission device is switchable between several functioning modes, including:

- a fifth functioning mode, where the first clutch is in the closed state, and the electric motor drives the input device in rotation.

Another aspect of the disclosure concerns a cooling circuit for an internal combustion engine, the cooling circuit comprising:

- a fan, and
- the transmission device previously described, wherein the output device is linked to the fan.

Another aspect of the disclosure concerns a vehicle, comprising:

- an engine, and
- the cooling circuit as previously described, wherein the input device is linked to the engine.

Additional features and advantages are disclosed in the following description, claims, and drawings, and in part will be readily apparent therefrom to those skilled in the art or recognized by practicing the disclosure as described herein. There are also disclosed herein control units, computer readable media, and computer program products associated with the above discussed technical effects and corresponding advantages.

BRIEF DESCRIPTION OF THE DRAWINGS

With reference to the appended drawings, below follows a more detailed description of aspects of the disclosure cited as examples.

DETAILED DESCRIPTION

Aspects set forth below represent the necessary information to enable those skilled in the art to practice the disclosure.

Figure 1:
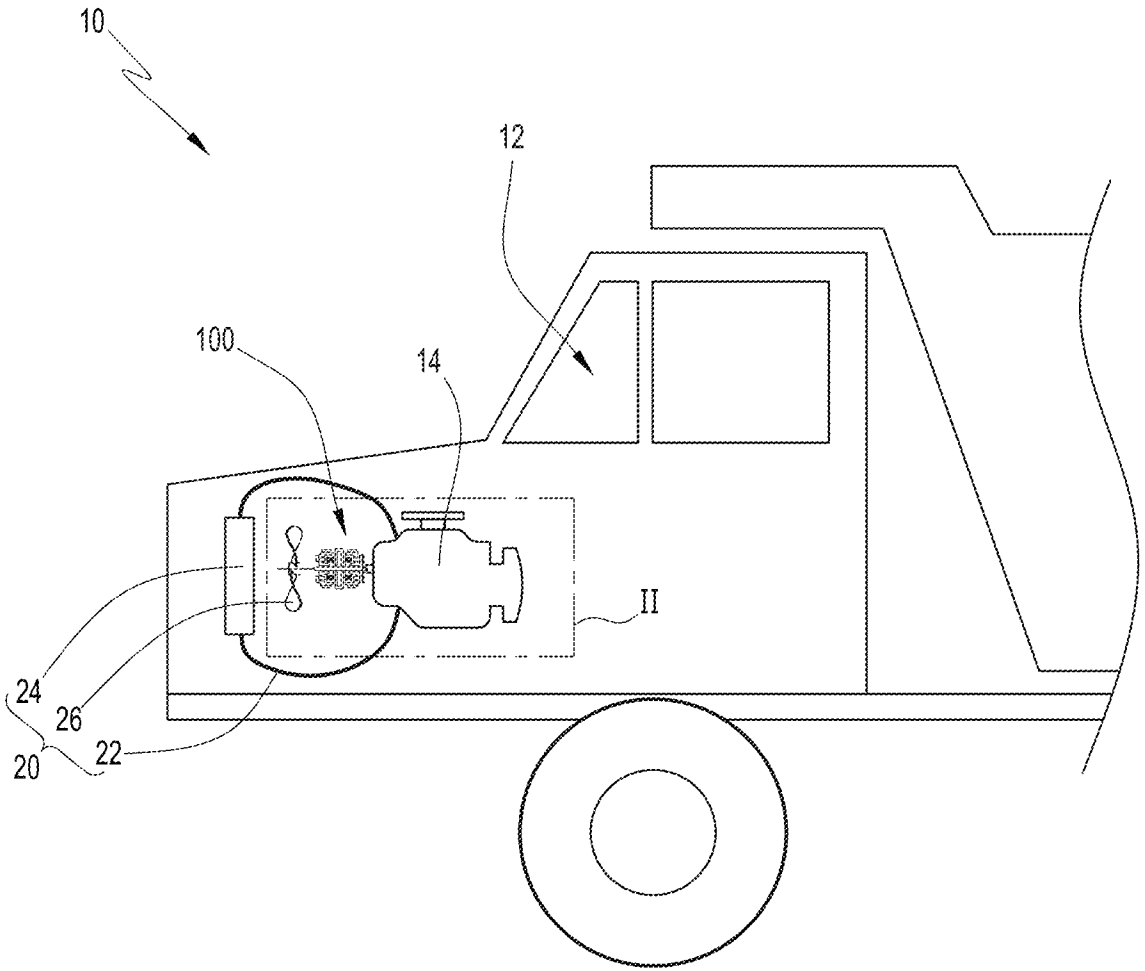
FIG. 1 represents an exemplary vehicle according to one example of the invention.

FIG. 1 represents an exemplary vehicle 10 according to the invention. In the illustrated example, the vehicle 10 is a dump truck. Alternatively, the vehicle 10 is a bus, a truck, or a boat, etc. The invention is not limited to a particular type of vehicle. The vehicle 10 comprises a cabin 12, where a driver and/or passengers may take place.

The vehicle 10 comprises an engine 14. The engine 14 is an internal combustion engine. The engine 14 uses fuel, stored in a tank of the vehicle 10, and dioxygen from the air surrounding the vehicle 10 to generate mechanical energy, while also releasing heat, i.e. thermal energy. The fuel tank is not represented.

In order to maintain the engine 14 within a suitable temperature range, the vehicle 10 also comprises a cooling circuit 20. The cooling circuit 20 comprises a cooling circuit 22, which is filled with a coolant fluid, and a heat exchanger 24. When the engine 14 is running, the engine 14 releases heat. Part of this heat is absorbed by the coolant, which circulates within the cooling circuit 22, then the heated coolant passes through the heat exchanger 24 and releases the heat previously absorbed. The coolant is usually a liquid, for example a mixture of water and glycol, while the heat exchanger 24 is usually an air/liquid heat exchanger.

Figure 2:
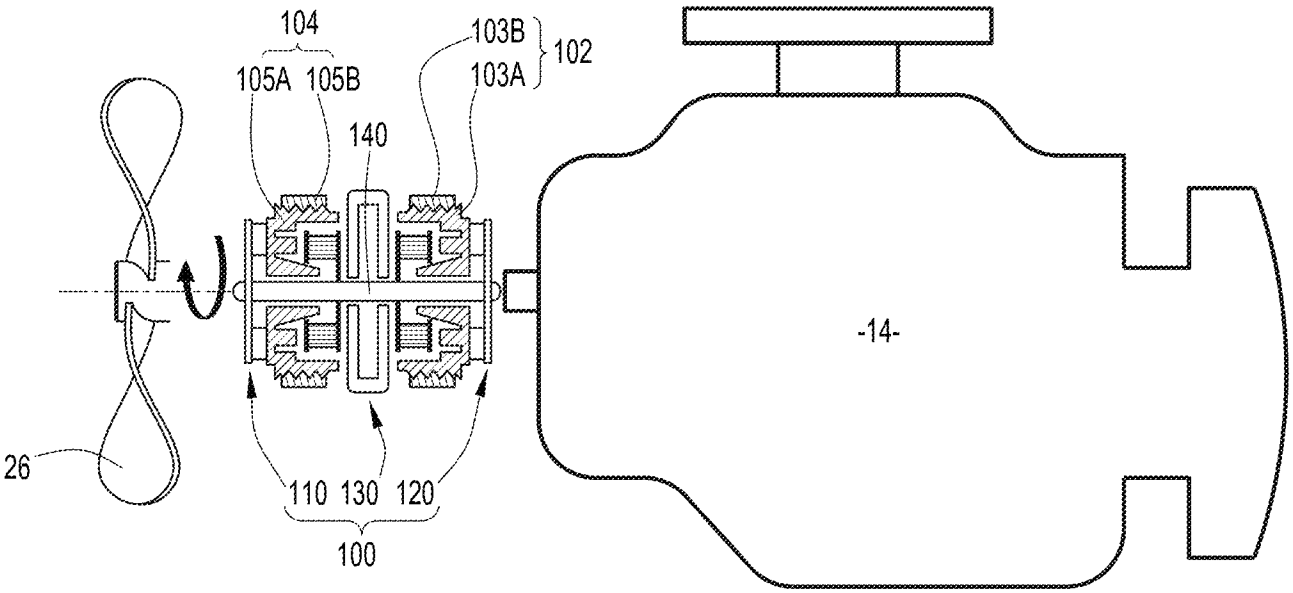
FIG. 2 is a close-up of a detail II marked on FIG. 1.

In order to force air circulation through the heat exchanger 24, the cooling circuit 20 also comprises a fan 26 and a transmission device 100, which is configured to drive the fan 26 in rotation. The transmission device 100 is represented at higher scale on FIG. 2.

The transmission device 100 comprises an input device 102, configured to be driven mechanically in rotation by the engine 14, and an output device 104, configured to be linked to the fan 26, so as to drive the fan in rotation. In the non-limiting illustrated example, the input device 102 is represented by a combination of a grooved wheel 103A with a belt 103B, the belt 13B being itself driven by the engine 14, for example driven by a crankshaft of the engine 14.

Alternatively, the input device 102 comprises a set of gears and chain, or any suitable device. Similarly, in the non-limiting illustrated example, the output device 104 is represented by a combination of a wheel 105A with a belt 105B. Alternatively, the output device 104 comprises a set of gears and chain, or any suitable device.

The transmission device 100 also comprises a first clutch 110, which is linked to the output device 104, and an electric motor 130, which is interposed between the first clutch 110 and the input device 102. The electric motor 130 is supplied with electrical energy from a storage unit of the vehicle 10, for example from a battery of the vehicle 10. The storage unit is not represented. Advantageously, the electric motor 130 is switchable between a motor mode, where the electric motor 130 is supplied with electric energy and produces mechanical force, and a generator mode, where the electric motor 130 is supplied with mechanical force and generates electric energy.

The transmission device 100 comprises a second clutch 120, which is linked to the input device 102 and which is interposed between the motor 130 and the input device 102. In other words, the electric motor 130 is interposed between the first clutch 110 and the second clutch 120. In the illustrated example, the first clutch 110 is linked to the second clutch 120 by a shaft 140, so that the first clutch 110 is coupled in rotation with the second clutch 120. The motor 130 is arranged around the shaft 140, so has to rotate the shaft 140 when the motor 130 is powered.

The first clutch 110 is switchable between a closed state, where the first clutch 110 connects mechanically the shaft 140 to the output device 104, so as to couple in rotation the output device 104 with the shaft 140, and an open state, where the output device 104 is not coupled in rotation with the shaft 140. In other words, when the first clutch 110 is in the closed state, the fan 26 in driven in rotation by the shaft 140 is rotating, whereas when the first clutch 110 is in the open state, the fan 26 is not driven in rotation by the shaft 140. The first clutch 110 is also called "fan clutch". Preferably, the first clutch 110 is electrically actuated, that is to say the first clutch 110 is controlled by an electric signal to switch between the closed state and the open state. Alternatively, the first clutch 110 is pneumatically actuated, or hydraulically actuated.

The second clutch 120 is switchable between a closed state, where the second clutch 120 mechanically connects the shaft 140 to the input device 102 so as to drive the shaft 140 in rotation when the engine 14 is running, and an open state, where the shaft 140 is not driven in rotation by the engine 14. The second clutch 120 is also called "engine clutch". Preferably, the second clutch 120 is electrically actuated, that is to say is controlled by an electric signal to switch between the closed state and the open state. Alternatively, the second clutch 120 is pneumatically actuated, or hydraulically actuated. Preferably, the first clutch 110 and second clutch 120 are both electrically actuated.

The first clutch 110 and the second clutch 120 are switchable between their respective open and closed states independently from each other, allowing for several advantageous functioning modes of the transmission device 100.

In an exemplary first functioning mode, the first clutch 110 and the second clutch 120 are both activated in their closed state, so that the input device 102 is coupled in rotation with the output device 104. The electric motor 130 is deactivated, for example in a free wheel mode. When the transmission device 100 is installed in the vehicle 10, the transmission device 100 transmits the mechanical force of the engine 14 to the fan 26, with minimal energy losses. The first functioning mode is also called "direct drive" mode.

In the illustrated example, the shaft 140 is in one piece, so the input device 102 and the output device 104 rotate at the same speed when the input device 102 and the output device 104 are coupled in rotation; for example when the transmission device 100 is in the first functioning mode. In an alternative not shown, a gear box, for example a planetary reducer, is arranged on the shaft 140, so that the input device 102 and the output device 104 rotate at different speeds when coupled in rotation.

In an exemplary second functioning mode, the second clutch 120 is in the open state, while the first clutch 110 is in the closed state. The output device 104 may be driven in rotation by the electric motor 130 at the desired speed. When the transmission device 100 is installed in the vehicle 10, the fan 26 may be driven in rotation by the electric motor 130 at the desired speed. For example, the second functioning mode may be used when the engine 14 is stopped—or runs at low speed—while cooling requirements are still high. The second mode improves cooling of the engine 14 even when the vehicle 10 is stopped or moves at low speed, reducing the risk of engine failure.

In an exemplary third functioning mode, the first clutch 110 is in the open state, while the second clutch 120 is in the closed state. The electric motor 130 is driven in rotation by the input device 102. When the transmission device 100 is installed in the vehicle 10, the electric motor 130 is used as an alternator, which is driven by the engine 14. The third functioning mode, also called "regeneration mode", may be used for example as an auxiliary engine brake when the vehicle decelerates, or when the vehicle 10 runs downhill. The electric motor 130 used as a generator produces electric power, which may be stored in a suitable device of the vehicle 14, or directly used. The electric motor 130 produces an additional engine brake effort, which reduce the use of traditional brakes and generates extra energy.

In an exemplary fourth functioning mode, the first clutch 110 and the second clutch 120 are both in the closed state, and the electric motor 130 is used as an alternator. The engine 14 drives simultaneously the fan 26 and the electric motor 130 used as an alternator. In other words, the fourth functioning mode offer simultaneously engine brake, energy production and efficient cooling.

Depending on the size/voltage/power level of the electric motor 130, the transmission device 100 can also be used to start the engine 14 when the engine 14 is initially stopped. For this purpose, in an exemplary fifth functioning mode of the transmission device 100, the second clutch 120 is in the closed state, and the electric motor 130 is used to drive the input device 102 in rotation, and, by extension, to drive the engine 14 is rotation. The first clutch 110 is preferably in the open state.

More generally, depending on the operating conditions of the vehicle 10, the transmission device 100 is switchable between various functioning modes, including one or more functioning modes among the first mode, the second mode, the third mode, the fourth mode and the fifth mode described above. Preferably, the transmission device 100 is switchable at least between the first mode, the second mode, and the third mode.

As a result, when the transmission device 100 is linked to the fan 26 of the cooling circuit 20, the transmission device 100 helps the overall operation of the vehicle 10, allowing for an efficient functioning depending on the operating conditions of the vehicle 10. In particular, the transmission device 100 allows energy recuperation when the vehicle 10 is braking, which improves energy efficiency of the vehicle 10.

In the illustrated examples, the engine 14 and cooling circuit 20 are part of the vehicle 10, i.e. on-board the vehicle 10, for mobile use. Alternatively, and not shown, the engine 14 and cooling circuit 20 are used in a stationary application, for example as part of a generator set.

The terminology used herein is for the purpose of describing particular aspects only and is not intended to be limiting of the disclosure. As used herein, the singular forms "a", "an", and "the" are intended to include the plural forms as well, unless the context clearly indicates otherwise. As used herein, the term "and/or" includes any and all combinations of one or more of the associated listed items. It will be further understood that the terms "comprises", "comprising", "includes", and/or "including" when used herein specify the presence of stated features, integers, steps, operations, elements, and/or components, but do not preclude the presence or addition of one or more other features, integers, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the inventive concepts being set forth in the following claims.

What is claimed is:

1. A transmission device for a fan of a cooling circuit of an internal combustion engine, the transmission device being configured to drive the fan in rotation and comprising:

an input device, configured to be driven in rotation by the engine; and an output device, configured to be linked to the fan so as to drive the fan in rotation;

wherein the transmission device comprises:

a first clutch, which is linked to the output device;

a second clutch, which is linked to the input device;

a shaft, which connects mechanically the first clutch to the second clutch; and an electric motor, which is arranged on the shaft between the first clutch and the second clutch; and wherein:

the first clutch is switchable between a closed state, where the first clutch mechanically connects the shaft to the output device, so as to couple in rotation the output device with the shaft, and an open state, where the output device is not driven in rotation by the shaft;

the second clutch is switchable between a closed state, where the second clutch mechanically connects the shaft to the input device so as to couple the shaft in rotation with the input device, and an open state, where the shaft is not driven in rotation by the input device; and the first clutch and the second clutch are switchable, between their respective open and closed states, independently from each other.

2. The transmission device of claim 1, wherein the transmission device is switchable between several functioning modes, including:

a first functioning mode, where the first clutch and the second clutch are both in a closed state, so that the input device is coupled in rotation with the output device;

a second functioning mode, wherein:

the second clutch is in the open state;

the first clutch is in the closed state;

the output device is configured to be driven in rotation by the electrical motor; and a third functioning mode, wherein:

the first clutch is in the open state;

the second clutch is in the closed state; and the electric motor is configured to be driven in rotation by the input device, the electric motor acting as an alternator.

3. The transmission device of claim 2, wherein the transmission device is switchable between several functioning modes, including:

a fourth functioning mode, wherein:

the first clutch and the second clutch are both in the closed state; and the electric motor is used as an alternator.

4. The transmission device of claim 3, wherein the transmission device is switchable between several functioning modes, including: a fifth functioning mode, wherein: the first clutch is in the closed state; and the electric motor drives the input device in rotation.

5. A cooling circuit for an internal combustion engine, the cooling circuit comprising:

a fan; and the transmission device of claim 1;

wherein the output device is linked to the fan.

6. A vehicle, comprising:

an engine; and the cooling circuit of claim 5;

wherein the input device is linked to the engine.

* * * * *